United States Patent [19]

Prodel

[11] Patent Number: 4,643,512

[45] Date of Patent: Feb. 17, 1987

[54] INSULATED BRANCHING CONNECTOR FOR ELECTRICAL CABLES

[75] Inventor: Michel H. M. F. Prodel, Troche, France

[73] Assignee: SICAME Societe Industrielle de Construction d'Appareils et de Materiel Electriques, Arnac Pompadour, France

[21] Appl. No.: 744,331

[22] Filed: Jun. 13, 1985

[30] Foreign Application Priority Data

Jun. 15, 1984 [FR] France ..... 84 09384

[51] Int. Cl.[4] ..... H01R 13/24

[52] U.S. Cl. ..... 339/248 R; 339/272 R; 339/96; 339/246

[58] Field of Search ..... 339/242, 246, 272 R, 339/272 A, 272 B, 268 R, 265 R, 96, 97 R, 97 P, 339/98, 99

[56] References Cited

U.S. PATENT DOCUMENTS

| | | | |
|---|---|---|---|
| 2,538,912 | 1/1951 | Road et al. | 339/272 A |
| 3,112,148 | 11/1963 | Wochner | 339/246 |
| 3,585,571 | 6/1971 | Davis et al. | 339/272 A |
| 3,602,871 | 8/1971 | Newman | 339/272 A |
| 3,848,956 | 11/1974 | Kraft | 339/98 |
| 3,869,189 | 3/1975 | McCurdy | 339/272 A |
| 4,050,761 | 9/1977 | De France | 339/97 |
| 4,247,159 | 1/1981 | Fruchard | 339/246 |
| 4,293,176 | 10/1981 | Lindlöf | 339/246 |
| 4,413,876 | 11/1983 | Borne et al. | 339/272 B |
| 4,458,976 | 7/1984 | Hudson et al. | 339/248 R |

FOREIGN PATENT DOCUMENTS

| | | | |
|---|---|---|---|
| 669191 | 12/1938 | Fed. Rep. of Germany | 339/272 B |
| 2626906 | 12/1977 | Fed. Rep. of Germany . | |
| 1195439 | 11/1959 | France . | |
| 1534124 | 7/1968 | France . | |
| 2058441 | 5/1971 | France . | |
| 2370369 | 6/1978 | France . | |
| 391560 | 5/1933 | United Kingdom | 339/272 B |
| 1431443 | 4/1976 | United Kingdom . | |

*Primary Examiner*—Gil Weidenfeld
*Assistant Examiner*—Paula A. Austin
*Attorney, Agent, or Firm*—Charles E. Brown; Charles A. Brown

[57] ABSTRACT

This is a branching connector for establishing a branch connection between a main cable (15) and at least one branch cable (15').

In accordance with the invention, at least the projecting part of contact members (17, 65 65') employed for this purpose is embedded in an insulating material dished member (42, 42', 76, 76') adapted to be applied against a cable (15, 15') of this kind all around it and so to seal and protect the electrical contact established between it and this cable (15, 15').

Application, inter alia, to the connection of users to overhead electrical power distribution networks.

25 Claims, 21 Drawing Figures

INSULATED BRANCHING CONNECTOR FOR ELECTRICAL CABLES

The present invention is generally concerned with electrical branching connectors for making an electrical connection between a first or main cable, generally already installed, and at least one second or branch cable to be connected to the former.

One particular application of electrical branching connectors of this kind concerns the connection of users to overhead electrical power distribution networks, whether these networks comprise bare cables held at a distance from one another or twisted insulated cables.

Generally speaking, they comprise a body, a jaw movably mounted on said body under the control of clamping means and defining with the body a housing whereby the connector may be fitted to a main cable, connecting means for connecting at least one branch cable to said body and a contact member accommodated in said body having a projecting part extending into said housing, adapted to establish an electrical connection between the main cable and a branch cable of this kind.

Branching connectors of this type are described, for example, in French patent No. 1 195 439 of Apr. 26, 1958 and French patent No. 2 058 441 filed Sept. 4, 1969 under application number 69 30124.

In the first of these patents, which is specifically concerned with branching connectors designed to be fitted to cables which have to be stripped or to bare cables, the contact member is merely adapted to bear on the cable.

In the second, which concerns branching connectors designed to be fitted to insulated cables, the contact member is adapted to pass through the insulative sheath of the cables, an insulating piercing projecting part being divided to this end into teeth, blades or other piercing members adapted to pierce the sheath.

In both cases the body and jaw are of metal.

In both cases disconnection of the branch cable entails further work in respect of the contact with the main cable.

However, there do exist branching connectors, usually called separate branch connectors, enabling the branching cable to be conected or disconnected without affecting the contact with the main cable.

Be this as it may, one of the major problems to be solved with brancing connector results from the necessity to maintain for an effectively unlimited period the electrical contacts made by them.

It has been found that most operating faults affecting user connections result from degradation of these electrical contacts with time, generally through oxidation or corrosion.

In the case of branching connectors with metal body and jaw, as mentioned above, it has been proposed to provide the branching connectors with a cover, in practice of insulative material, which completely encloses it and which is designed to contain a quantity of grease.

By virtue of the material from which it is made, a cover of this kind to some extent restores the insulation around the electrical contacts to be protected, appropriately insulating same.

At the same time, the grease that it contains seals the electrical contacts from the outside environment.

An arrangement of this kind has given satisfaction and may continue to do so.

It does have disadvantages, however, as follows:

First of all, it is difficult to fit the cover and this complicates installation, especially when the branching connector concerned is in place on a main cable forming part of a twisted bundle, in which case wedges or separators have to be inserted between the various cables constituting the bundle to enable the cover to be fitted to the branching connector.

Futhermore, in certain cases at least branching connectors equipped with a cover in this way permit only a specific orientation of the branch cable outlet, generally downwards, and given the different lays of the various cables constituting the twisted bundle, this is more often than not an additional constraint with regard to the fitting of the set of connectors, of which there are generally four, used to connect each user, the corresponding branching connectors having to be spaced along the main axis of the bundle to position the branch cable outlets appropriately.

Also, and above all else, the grease employed itself gives rise to problems.

Apart from the fact that it is required to retain its properties in spite of attack by atmospheric agents, especially in a saline environment, which is not in fact achieved, it must also have sufficient mass to close off optimally the various points where water may enter between the branching connector and its cover.

It must therefore be applied in excess so that when the cover is fitted it is seen to leak from the cover.

More often than not the quantity of grease required is deposited in the cover in advance, in the factory, as a result of which the cover is more than sufficiently filled with grease.

As an alternative, the grease may be deposited in situ, on the site where the cover is used, before the cover is fitted.

In all cases this leakage of grease from the cover when the latter is fitted results in disagreeable and lasting soiling of the insulative gloves which the fitter is obliged to wear during this operation.

Because of this, fitters tend, for their own convenience, to remove some of the grease deposited in the cover in the factory or, with greater justification, to deposit only a reduced quantity of grease in the cover in situ, in both cases compromising the required sealing effect.

Furthermore, while perfect application of a grease of this kind in sufficient quantity actually secures the necessary sealing effect in the laboratory, this does not apply in a consistent and reliable way on site, as the precautions which must be taken on fitting a cover filled with this grease are not followed as scrupulously as would be desirable, this often being impossible, in fact.

There exist certain so-called insulating branching connectors which pierce the insulation of the main cable and that of the branch cable and which eliminate the need to re-establish the insulation by means of a cover containing grease.

These are branching connectors of which the body and the jaw are of an insulative material, not of metal, said body and said jaw in practice constituting two shells which, forming between them two parallel housings, one for the main cable and the other for the branch cable, and equipped internally with metal contact members of the insulation piercing type projecting into said housings, are fastened to one another by one or more bolts operative between these housings.

These insulating branching connectors themselves have certain disadvantages.

Firstly, the clamping force developed by the bolt or bolts which they comprise is divided in a somewhat random manner between the main cable and the branch cable, by virtue of the significant difference in diameters which usually applies.

Also, as this clamping force is at best only divided half and half between the two cables for each of the bolts, such use of a fastening bolt is not fully satisfactory.

Finally, and above all else, the metal contact members are operative simultaneously on both cables and it is not possible to disconnect the spur cable, if required, without affecting the contact with the main cable.

A general object of the present invention is a branching connector advantageously exempt of these various disadvantages and further featuring other advantages.

This branching connector is of the kind comprising an insulative material body, an insulative material jaw movably mounted on said body under the control of clamping means and defining with the body a housing whereby the assembly may be fitted to a main cable, means for clamping said jaw, connecting means for connecting at least one branch cable to said body, and a metal contact member accommodated in said body and having an insulation piercing projecting part extending into said housing and adapted to make an electrical connection between said main cable and a branch cable of this kind, and is generally characterized in that at least the projecting part of the metal contact member which extends into the main cable housing is embedded in an insulative material dished member adapted to be applied against a cable of this kind all around said projecting part so as to protect and seal the electrical contact established between said projecting part and said main cable, in that the connecting means for connecting a branch cable to the body comprise a second jaw separate from the first jaw movably mounted on said body under the control of specific clamping means and defining with said body a housing adapted to have a branch cable inserted into it, and in that, the metal contact member comprising a second insulation piercing projecting part extending into the branch cable housing, this second projecting part is also embedded in an insulative material dished member adapted to be applied against the branch cable all around the second projecting part so as to protect and seal the electrical contact established between the second projecting part and said branch cable, whereby the connector constitutes a separate branch insulating branching connector, insulation piercing on the main cable and the branch cable(s).

It is to be understood that when, as is preferably the case, to achieve a balanced and positive bearing relationship on the core of the cable concerned, both on the side of the body and on the side of the jaw, said jaw also carries a metal contact member of which an insulation piercing projecting part extends into the housing for said cable, an arrangement of the same type, involving an insulative material dished member, is adopted for this jaw, said projecting part on the contact member of the jaw being also embedded in a dished member of this kind, for application of the dished member to said cable around the corresponding contact.

In other words, the branching connector in accordance with the invention is equipped with sealing means adapted to achieve appropriate and reliable insulation of all the electrical contacts which may have been made within it.

It thus constitutes of itself a fully insulated connector without it being necessary to associate with it for this purpose any form of insulative cover or any quantity of grease.

Its use is thereby simplified.

Any insulative material dished member which the branching connector in accordance with the invention comprises, fabricated in a flexible material, preferably features two elastically deformable lips extending parallel to the associated housing along the projecting part of the corresponding metal contact member, one on each side of said projecting part, adapted to be applied against the respective cable, and, one on each side of said projecting part, either two transverse cradle members adapted to be applied against said cable or two transverse cheek members each comprising a breakable part in line with said projecting part.

In this way the branching connector in accordance with the invention may advantageously be used for a relatively wide range of different cross-section cables, both with regard to the main cable and with regard to the branch cable or cables, the insulative material dished member or members that it comprises of themselves adapting, by virtue of their inherent elasticity, to said cables.

The branching connector in accordance with the invention further offers the advantages of total separation between the active metal parts which make the contacts and carry the electricity and the passive insulative parts procuring insulation; excellent transmission of the clamping force to the active metal parts, each jaw transmitting to the cable concerned all of the clamping force which is applied to it, minimum overall dimensions; total absence of any projecting metal part likely to generate radio frequency interference when live; use of a minimum number of different component parts, all of relatively simple manufacture and all particularly suited to transmission under optimum conditions of the clamping forces which are applied to them; grouping together on a single surface of the members which have to be operated upon in order to develop these clamping forces; the facility for using an ordinary wrench for the latter purpose, rather than an insulated wrench; a tangential outlet for the branch cable or cables, parallel to the axis of the main cable, and thus to the twisted bundle to which the latter may possibly belong, without any constraints as to positioning; and the facility for virtually instantaneous and stable temporary positioning on the main cable before any clamping force is applied, such clamping force being required only subsequently, for the definitive positioning and application of power.

The means for clamping any jaw that the branching connector in accordance with the invention comprises preferably consist of a screw the operating head of which is adapted to twist off, said screwhead being in a material other than that of the shank of said screw, from which it is separate and to which it is appropriately attached, as by crimping, for example.

In this way it is possible to make the shank of the screw of steel, which is favorable to obtaining the screw at reduced manufacturing cost and with minimum overall dimensions given the clamping forces that it has to absorb, while fabricating the screwhead from stainless light alloy which eliminates any possibility of corrosion of the latter and in particular of the broken surface following elimination of the detachable part, a screwhead of this kind being advantageously resistant to corrosion throughout.

Any mobile jaw which the branching connector in accordance with the invention comprises is preferably slidably engaged on guide rails provided for this purpose on the body with which it is associated, which advantageously eliminates any bending force on the corresponding clamping screw, procuring maximum clamping efficiency from said screw.

Finally, advantageously employing a separate jaw for the branch cable or cables, the branching connector in accordance with the invention is a true separate branch connector enabling any branch cable to be connected and disconnected without affecting the contact with the corresponding main cable.

In all cases, because of its inherent gas-tightness the spur connector in accordance with the invention is particularly reliable and secure.

In practice, if mounted on and clamped to a short section of insulated cable at a voltage of 6 kV, for example, and totally immersed in slightly conductive water, no electical breakdown is observed between the electrical contacts made within it, and it may therefore be used on copper of aluminum cored insulated cables without risk of galvanic corrosion due to any possibility of bimetallic contact between the core and the metal contact members that it comprises.

The characteristics and advantages of the invention will appear from the following description given by way of example with reference to the accompanying drawings, in which.

Figure 1:
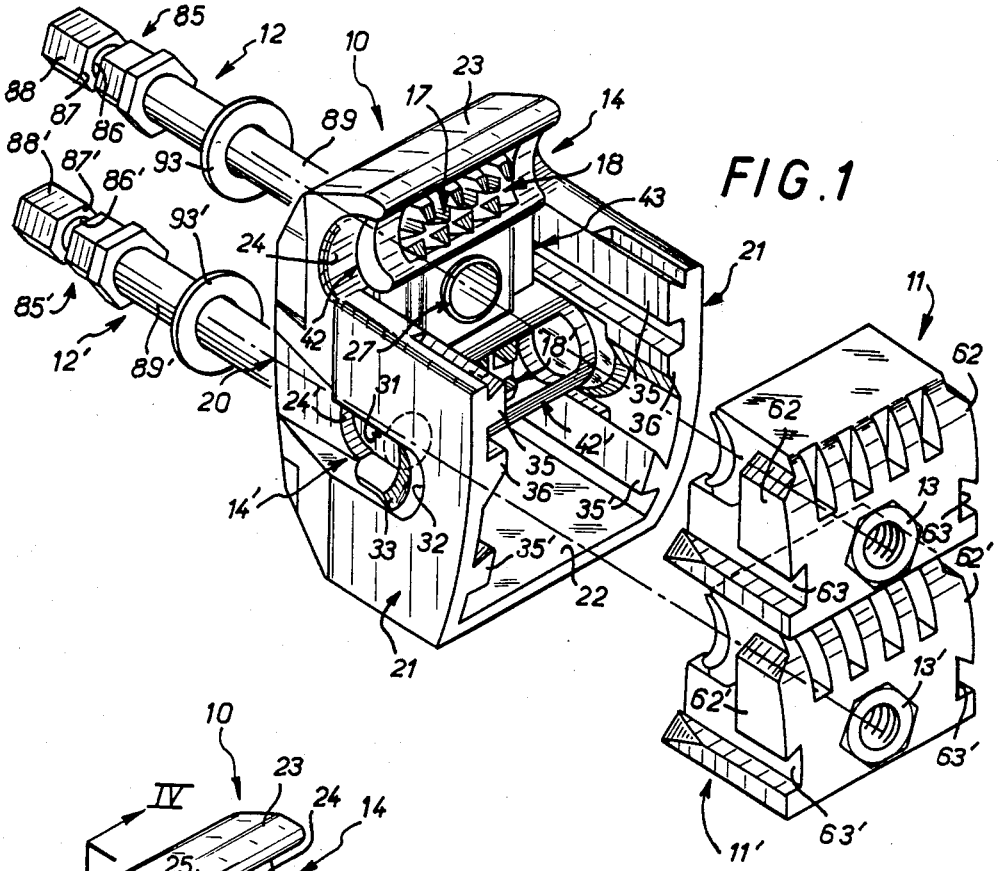
FIG. 1 is an exploded view in perspective of a branching connector in accordance with the invention.

As shown in the figures, the branching connector in accordance with the invention generally comprises, in all its embodiments, an insulative material body 10, an insulative material jaw 11 movably mounted on said body 10 under the control of clamping means consisting in practice of a screw 12 designed to cooperate with a captive nut 13 on said jaw 11 which defines with the body 10 a housing 14 whereby the assembly may be fitted to a main cable 15 schematically represented in chain-dotted line in FIGS. 18 through 21, connection means to be be described in detail hereinafter with reference to the various embodiments for connecting to said body 10 at least one branch cable 15' also schematically represented in chain-dotted line in FIGS. 18 through 21, and a metal member 17 housed in said body 10 and having an insulation piercing projecting part 18 extending into said housing 14 of the latter and adapted, as described hereinafter, to establish an electrical connection between the main cable 15 and a branch cable 15' of this kind.

Also, in all the embodiments shown, the connecting means for connecting to the insulative material body 10 a branch cable 15' comprise a second jaw 11' which is separate from the first jaw 11 and, like the latter, movably mounted on said body 10 under the control of specific clamping means consisting in practice of a clamping screw 12' designed to cooperate with a captive nut 13' on this second jaw 11' and which defines with said body 10, parallel to the aforementioned housing 14, a housing 14' into which a branch cable 15' of this kind may be inserted.

Generally speaking, in the embodiment specifically shown in FIGS. 1 through 17, the insulative material body 10 comprises a back member 20 and two lateral flanges 21 disposed along respective edges of said back member 20, over part only of the height of said back member 20 as measured from its base, perpendicular to the housings 14, 14' for the cables 15, 15'.

It further comprises, in this embodiment, a baseplate 22 joining these two flanges 21 together at the base of its back member 20.

The part 23 of the back member 20 which extends beyond the flanges 21 corresponds to the housing 14 for the main cable 15 and is generally hook-shaped, forming at each end of the housing 14 a cradle member 24 with a concave side facing towards the jaw 11.

In the back member 20, more precisely on the side thereof facing towards the jaws 11, 11', there is formed a housing 25 for the contact member 17 with, projecting from the back of this housing 25, a hollow member 27 adapted to have the clamping screw 12 passed through it.

Figure 4:
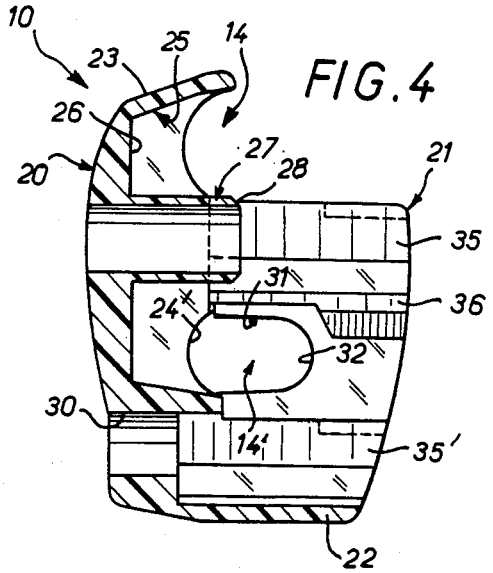
FIG. 4 is a view of it in transverse cross-seciton on the line IV—IV in FIG. 2.

As shown, the end edge of this hollow member 27 on the same side as the jaws 11, 11' is preferably bevelled by means of a chamfer 28 which diverges in the direction towards the back 26 of the associated housing 25 (FIG. 4).

In practice, and as shown here, the housing 25 is generally recessed, having the shape of a truncated pyramid, for example.

In its upper part it intersects the housing 14 for the main cable 15 and in its lower part it similarly intersects the housing 14' for the branch cable 15', the corresponding portion of its edges then forming a cradle member 24' at each end of the housing 14'.

Like the cradle members 24, the cradle members 24' have concave sides facing towards the jaws 11, 11'.

At its base, between the housing 25 and the baseplate 22, the back member 20 incorporates a hole 30 for the clamping screw 12' to pass through.

Each of the flanges 21 has an opening 31 in line with the housing 14' for the branch cable 15' to pass through.

This is a generally oblong opening the end 32 of which opposite the corresponding cradle member 24' is, like the latter, generally rounded, with its concave side facing towards that of the cradle member 24'.

Figure 5:
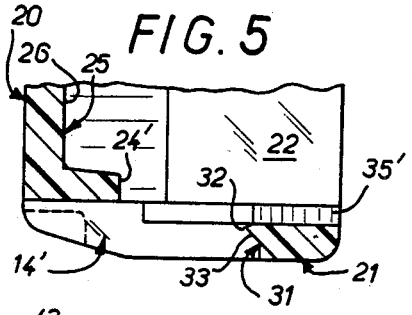
FIG. 5 is another partial view of it in cross-section on the line V—V in FIG. 2.
Figure 6:
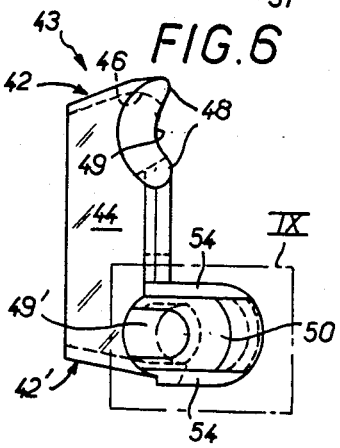
FIG. 6 is a view in elevation as seen in the direction of the arrow VI in FIG. 2 of the insulative material part associated with the metal contact member fitted to this body.

For reasons which will emerge hereinafter, the edge 32 of the opening 31 in each of the flanges 21 has projecting from it a bead 33 the inside surface of which forms an extension of that of the flange 21 in question, while its outside surface is generally conical, converging in the direction towards the back member 20 (FIG. 5).

The flanges 21 feature guide rails 35, 35' projecting from their respective inside surfaces and in corresponding relationship to one another for the jaws 11, 11' which are staggered along their height.

In the embodiment shown these are ribs the general shape of which in transverse cross-section is preferably, and as shown here, that of a trapezium with one end at 90°, merging through its shorter parallel side with the corresponding flange 21 and thus forming with the flange 21 half a dovetail.

These guide rails 35, 35' extend parallel to one another, substantially perpendicular to the back member 20.

In practice the median plane in which the guide rails 35 for the jaw 11 substantially extend contains the axis of the hollow member 27 for the clamping screw 12 and, likewise, the median plane in which extend the guide rails 35' for the jaw 11' contains the axis of the hole 30 for the clamping screw 12'.

In the embodiment shown there is associated with each of the guide rails 35 a counter-rail 36 parallel to the associated guide rail and projecting from the inside surface of the flange 21 in question, the baseplate 22 of itself forming a counter-rail of this kind for the guide rails 35'.

Like the rail 35 with which it is associated, a counter-rail 36 of this kind preferably has, as shown here, a transverse cross-section in the shape of a trapezium with one end at 90°, merging through its longer parallel side with the corresponding flange 21.

As is easily understood, the insulative material body 10 thus constituted may be molded from an appropriate synthetic material, for example a hard synthetic material of the 6-6 polyamide type reinforced with glass fibers.

Overall, it has a plane of symmetry passing through the axis of the hollow member 27 of its back member 20 and the axis of the hole 30 in the latter.

Figure 2:
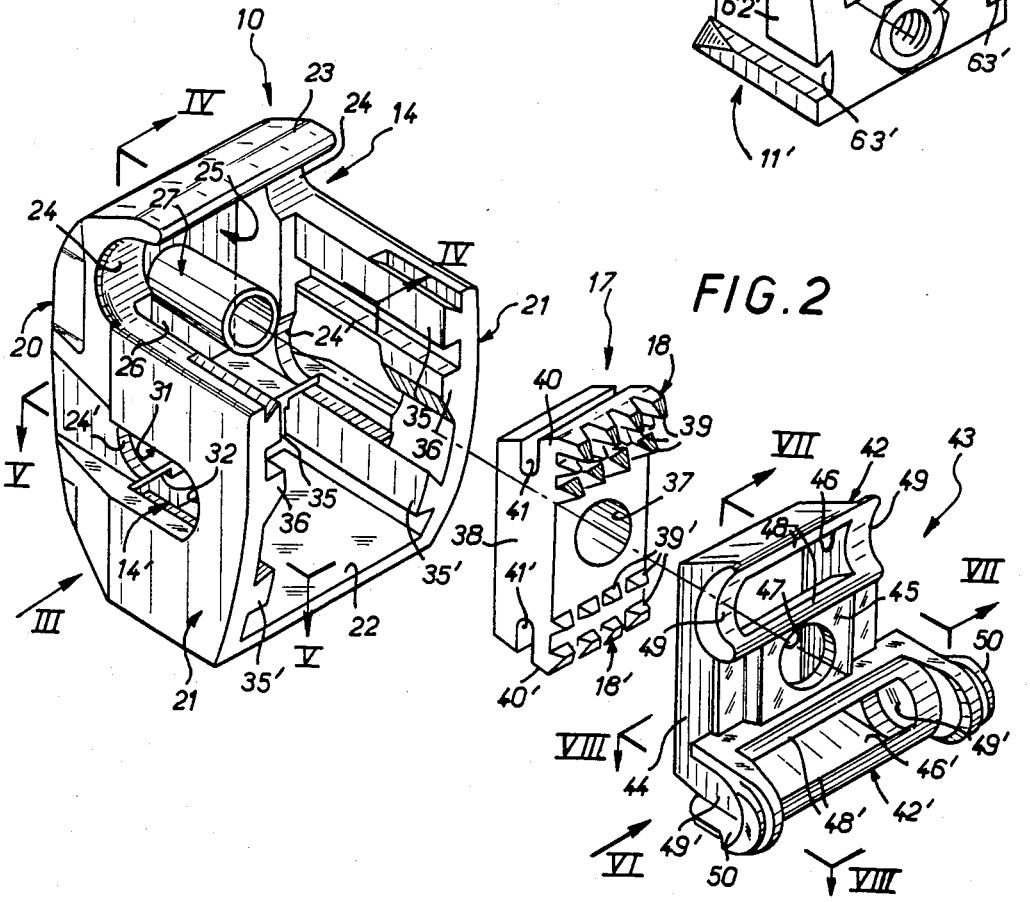
FIG. 2 is exploded view in perspective of the body of the branching connector and the various component parts of same.
Figure 3:
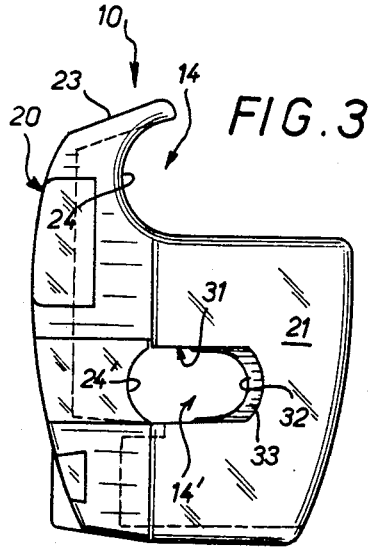
FIG. 3 is a view in elevation of the body only in the direction of the arrow III in FIG. 2.

In the embodiment shown in FIGS. 1 through 17, the metal contact member 17 features a plate 38 the general shape of which is that of a truncated pyramid, corresponding to the housing 25 provided for it in the back member 20 of the insulative material body 10 and which, in its median part, features an opening 37 for engaging it over the hollow member 27 of the back member 20 (FIG. 2).

The projecting part 18 of this contact member 17 extending into the housing 14 for the main cable 15 extends transversely to one end of this plate 38 and, at the other end of the latter, there similarly extends a projecting part 18' extending into the housing 14' for the branch cable 15'.

In order to pierce the insulation, the projecting parts 18, 18' which the contact member 17 thus features are each divided into piercing members 39, 39'; as shown here, these are in practice teeth.

The projecting part 18 thus features, in the embodiment shown, three rows of teeth 39, whereas the projecting part 18' features only two rows of teeth 39', said rows of teeth extending parallel to the corresponding housings 14, 14'.

In practice, in the embodiment shown, each of the projecting parts 18, 18' of the contact member 17 is carried by a portion 40, 40' of the plate 38 of the latter separated from the main part of the plate 38 by a slot 41, 41'.

In this way each of the projecting parts 18, 18' extends at least in part cantilever-fashion relative to the main part of the plate 38, which advantageously gives it a certain elasticity, whilst retaining its overall rigidity.

As is easily understood, the contact member 17 thus constituted may be fabricated from aluminum, for example, by machining an appropriate block of this metal.

Within the insulative material body 10 the projecting part 18 of the contact member 17 is embedded in an insulative material dished member 42 adapted to be applied against the main cable 15 all around said projecting part 18 so as to protect and seal the electrical contact established between the latter and the main cable 15.

Likewise, the projecting part 18' of the contact member 17 is also embedded in an insulative material dished member 42' adapted to be applied against the branch cable 15' all around the latter so as to protect and seal the electrical contact established between it and said branch cable 15'.

In practice, the dished members 42, 42' thus associated with the contact member 17 form parts of a common insulative material member 43 which features a skirt 44 engaged over said contact member 17, said skirt being like the contact member 17 in the general shape of a truncated pyramid, and a back 45 which covers the contact member 17.

This back 45 has two parallel openings 46, 46' at its ends each adapted to have the respective projecting part 18 or 18' of the contact member 17 pass through it and a central hole 47 in its median area adapted to have the clamping screw 12 pass through it, more precisely the hollow member 27 in which the screw is engaged.

Parallel to the passage 14, 14' with which it is associated, each dished member 42, 42' formed by the insulative material member 43 comprises, along the relevant projecting part 18, 18' of the contact member 17, and thus along the edges of its opening 46, 46', two elastically deformable lips 48, 48' one on each side of projecting part 18, 18' adapted to be applied to the corresponding cable 15, 15'.

In regard to the housing 14 for the main cable 15, the dished member 42 further comprises two transverse cradle members 49 disposed one on each side of the projecting part 18 of the contact member 17, each adapted to be applied against said main cable 15.

On the other hand, in regard to the housing 14' for the branch cable 15', the dished member 42' comprises two transverse cheek members 50 disposed one on each side of the projecting part 18' of the contact member 17, each forming a generally oblong extension of the dished member 42 and thus of the insulative material member 43 of which they form part, each comprising, in line with said projecting part 18' of the contact member 17, a breakable portion 49' for said branch cable 15' to pass through.

The edges of these cheek members 50, which overall are complementary to the openings 31 in the flanges 21 of the insulative material body 10, are each interlocked snap-fastener fashion with these openings 31.

Figure 9:
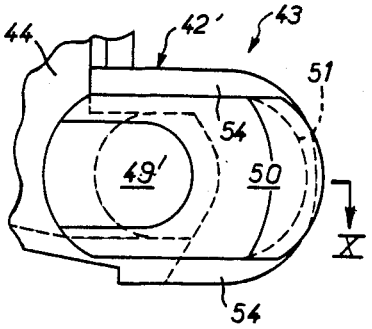
FIG. 9 shows to a larger scale the detail of FIG. 6 marked by a box XI thereon.
Figure 8:
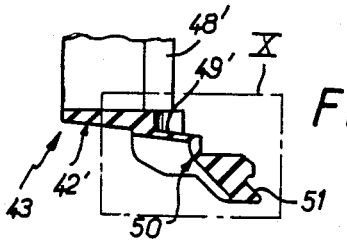
FIG. 8 is another partial view of it in cross-section on the line VIII—VIII in FIG. 2.
Figure 10:
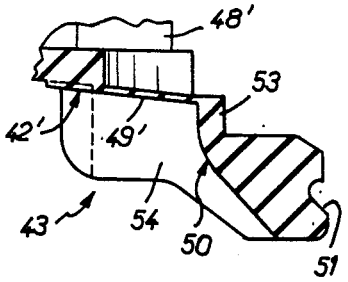
FIG. 10 is a view of this detail in crosssection on the line X—X in FIG. 9, corresponding to the detail X on FIG. 8, to the same scale.

To this end there is provided on their edge a groove 51 the profile of which is complementary to that of the bead 33 which projects from the back 32 of an opening 31 of this kind (FIGS. 8 through 10).

In practice, each cheek member 50 has in its median part a step 53, the portion of its edges featuring the groove 51 being offset laterally outwards relative to its breakable portion 49'.

In practice, each cheek member 50 features reinforcing ribs 54 projecting outwardly, one on each side of its breakable portion 49'.

Because of said ribs 54 and said step 53, each of the cheek members 50 forms generally, on the outside, a sort of ear which converges towards its breakable part 49'.

Figure 7:
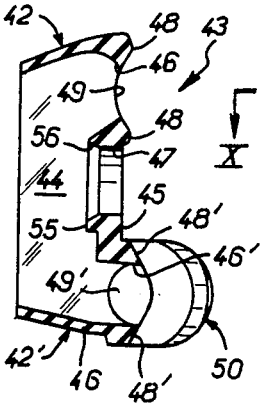
FIG. 7 is a view of this insulative material part in transverse cross-section on the line VII—VII in FIG. 2.

As shown here, the central hole 47 in the insulative material member 43 is preferably bordered on the inside surface of the back 45 by a rim 55 for application to the contact member 17 (FIG. 7).

The edge of this rim 55 is preferably bevelled, on the side of its inside surface, by a frustoconical chamfer 56 which diverges in the direction away from the associated back 45.

As is easily understood, the insulative material member 43 may, for example, be fabricated by molding any flexible synthetic material, such as a soft elastomer.

By virtue of the truncated pyramid shape of its skirt 44, it is retained on the contact member 17 when engaged thereon.

Furthermore, by virtue of its central hole 47 it is force-fitted over the hollow member 27 of the insulative material body 10 and its cheek members 50 mask off the respective openings 32 in the flanges 21 of the insulative material body 10, their groove 51 engaging snap-fastener fashion over the projecting bead 33 on the latter.

By virtue of this force-fitted engagement, on the one hand, and of this snap-fastener engagement, on the other hand, the combination consisting of the contact member 17 and the insulative material member 43 surrounding the latter is secured to the insulative material body 10.

As is readily understood, the engagement of said combination over the hollow member 27 of the insulative material body 10 is facilitated by the chamfers 28, 56 provided for this purpose on the hollow member 27 of the insulative material body 10 and on the rim 55 of the hole 47 in the insulative material member 43.

Figure 11:
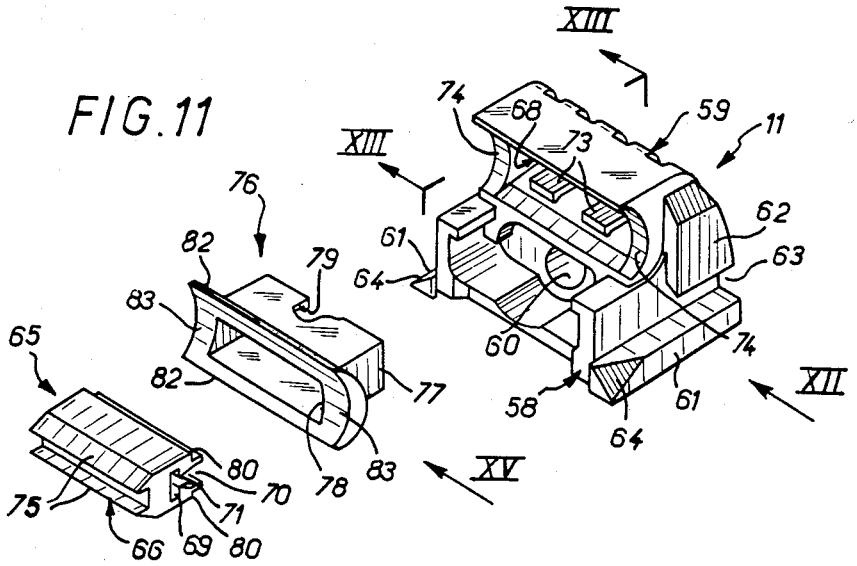
FIG. 11 is an exploded view in perspective of a jaw of the branching connector in accordance with the invention and the component parts of the jaw.
Figure 12:
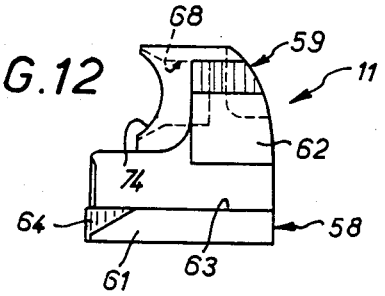
FIG. 12 is a view of this jaw in elevation in the direction the arrow XII in FIG. 11.
Figure 13:
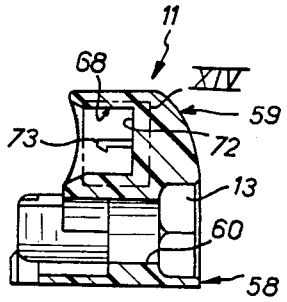
FIG. 13 is a view of it in transverse cross-section on the line XIII—XIII in FIG. 11.
Figure 14:
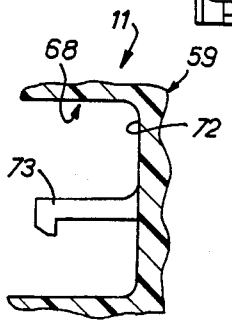
FIG. 14 shows to a larger scale the detail of FIG. 13 shown by a box XIV thereon.
Figure 15:
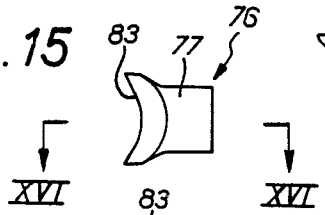
FIG. 15 is a view in elevation in the direction of the arrow XV in FIG. 11 of the insulative material part associated with the metal contact member equipping a jaw of the branching connector in accordance with the invention.
Figure 16:
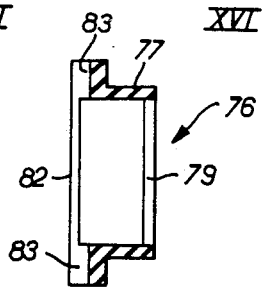
FIG. 16 is a view of this insulative material part in cross-section on the line XVI—XVI in FIG. 15.
Figure 17:
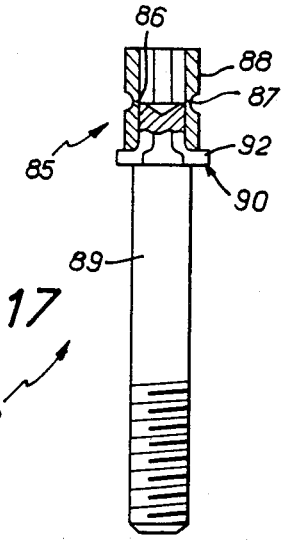
FIG. 17 is a view partly in elevation and partly in cross-section of a clamping screw associated with a jaw of a branching connector in accordance with the invention.
Figure 18:
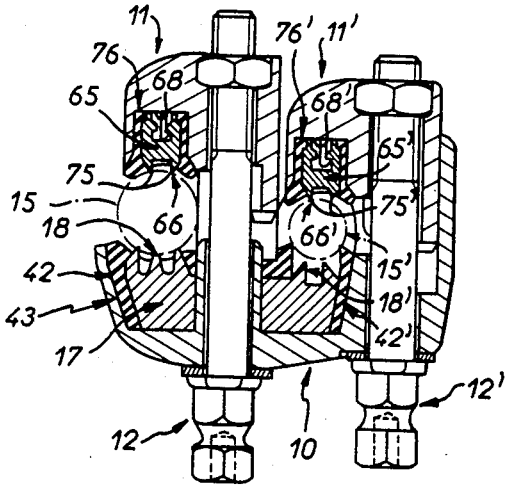
FIG. 18 is a view in transverse cross-section of the branching connector in accordance with the invention, showing how it is used.

In the embodiment specifically shown in FIGS. 1 through 17, the jaw 11 generally comprises a base 58 and a back member 59 projecting upwardly from the base 58 (FIG. 11).

In its median part the base 58 features a hole 60 for the clamping screw 12 to pass through with the associated captive nut 13 associated therewith at the end of the hole 60.

In the lateral direction, the base 58 comprises two ribs 61 projecting from respective lateral surfaces at its base, each forming with a boss 62 projecting from the corresponding lateral surface of the back member 59 a groove 63 complementary to the guide rails 35 of the insulative material body 10.

By virtue of the grooves 63 which it also comprises, the jaw 11 is slidably engaged on these guide rails 35.

To facilitate its engagement on the rail, each of these ribs 61 is bevelled by means of a chamfer 64 at its corresponding leading end.

The back member 59 extends level with the projecting part 23 of the back member 20 of the insulative material body 10 in order to define with the latter the housing 14 for the main cable 15.

In practice, in the embodiment shown, the jaw 11 carries, through the intermediary of its back member 59, a metal contact member 65 of which a projecting part 66 extends into the housing 14 for the main cable 15.

This contact member 65 is a section of preshaped profiled metal, aluminum, for example, simply snap-fitted into a housing 68 provided for this purpose in the back member 59 of the jaw 11.

To this end the contact member 65 features an inside channel 69 which discharges towards the rear via a slot 70, forming on the inside, on either side of the slot 70, two shoulders 71. Conjointly, the back member 59 of the jaw 11 features, projecting from the back 72 of its housing 68, in the median part of the latter, at least one elastically deformable hook 73 over which said contact member 65 may be engaged by said slot 70, until one and/or the other of these internal shoulders 71 becomes interlocked with a hook 73 of this kind.

In practice two hooks 73 are provided in this way, spaced from one another.

For reasons of ease of manufacture, their head projects from one side only.

At each end of the housing 14 for the main cable 15, the back member 59 forms a cradle member 74 having a concave side facing towards the projecting part 23 of the back member 20 of the insulative material body 10.

Like an insulative material body 10 of this kind, the jaw 11 may, for example, be made in rigid synthetic material, of the 6-6 polyamide type reinforced with glass fibers.

In the embodiment shown the projecting part 66 of the contact member 65 is also of the insulation piercing type, this projecting part being divided to this end into appropriate piercing members; more precisely, in the embodiment shown, it is divided into two sharp-edged blades 75 extending parallel to the axis of the housing 14 for the main cable 15, like the rows of teeth 39 of the projecting part 18 of the contact member 17 of the insulative material body 10.

Also, this projecting part 66 of this contact member 65 at least is also embedded in an insulative material dished member 76 adapted to be applied against the main cable 15 all around it and so protect and seal the electrical contact established between it and the main cable 15.

This dished member 76 comprises a skirt 77 engaged over the contact member 65 which it grips and a back formed with an opening 78 adapted to have the projecting part 66 of the latter pass through it.

In practice this opening 78 has the same contour as the skirt 77 so that the back in question is totally opened out, and is therefore non-existent.

On the other hand, at its other end the skirt 77 features two inwardly projecting rims 79 on its inside, projecting towards one another from two opposite edges, designed for bearing engagement against transverse shoulders 80 which the lips of the contact member 65 delimiting the slot 70 of the latter feature on their outside surface.

Parallel to the housing 14 for the main cable 15 with which it is associated, the dished member 76 comprises along the projecting part 66 of the contact member 65, and thus along the length of its own opening 78, two elastically deformable lips 82 disposed one on each side of said projecting part 66 of the contact member 65, for application to said main cable 15.

It further comprises two transverse cradle members 83 disposed one on each side of this projecting part 66 of the contact member 65, also adapted to be applied against the main cable 15.

In practice these cradle members 83 have a concave side facing towards the projecting part 23 of the back member 20 of the insulating material body 10 and each covers at least partially the respective cradle member 74 of the back member 59 of the jaw 11.

The jaw 11' is of identical structure to the jaw 11 and, like the latter, it carries a metal contact member 65' of which at least the projecting part 66' is embedded in an insulative material dished member 76'.

This jaw 11' will not therefore be described in detail here.

It is sufficient to indicate that like the jaw 11, to which it is parallel, it is slidably engaged on the guide rails 35' in the insulative material body 10, that the projecting part 66' of its contact member 65 projects into the housing 14' for the branch cable 15', the insulative material dished member 76' with which it is associated being adapted to be applied against the branch cable 15' all around it so as to protect and seal the electrical contact established between it and the branch cable 15', and that said projecting part 66' is also of the insulation piercing type, being as previously divided into two sharp-edged blades 75' parallel to the rows of teeth 39' of the projecting part 18' of the contact member 17 of the insulative material body 10.

However, in corresponding relationship with the profile of the counter-rails 36 of the insulative material body 10, the upper edge of the lateral bosses 62' of the jaw 11' is truncated by a chamfer.

The jaws 11, 11' being identical, the same applies to the upper edge of the lateral bosses 62 of the jaw 11.

The clamping screw 12 for the jaw 11 has an operating head 85 at least part of which can be twisted off, and the same applies to the clamping screw 12' for the jaw 11'.

The outside cross-section of the operating head 85 is polygonal, hexagonal for example, and it has an internal bore also of polygonal cross-section, hexagonal for example.

In this way it can be operated externally or internally, as required.

At mid-height it features a section 86 of reduced strength, or breakaway section, so as to be at least in part detachable.

This section 86 of reduced strength, which may result, for example and as shown here, from a groove 87 cut halfway into its thickness from its outside surface, delimits on it, at its end, a portion 88 which can be twisted off.

As shown here, the operating head 85 preferably forms, taken as a whole, a part which, separate from the shank 89 with which it is associated, being appropriately attached to the latter, is of a material other than the material of which said shank 89 is constituted.

For example, the operating head 85 may be fabricated from a metal of lower strength, such as aluminum, for example, whereas the shank 89 consists of a stronger metal, such as steel, for example.

The shank 89 is itself provided with a head 90 the cross-section of which is hexagonal, corresponding to that of the internal bore in the operating head 85, in order to engage the latter, and features at its base a stop collar 92.

It is to be understood that the head 90 of the shank 89 extends over part only of the height of the inside bore in the operating head 85, both to provide free access to the latter from the outside and to leave free the twist-off portion 88.

Thus it extends only to a point in line with the groove 87 in the operating head 85.

After the operating head 85 is engaged over it, the head 80 is crimped to the shank 89, by punching its end surface.

The shank 89 is smooth over a significant portion of its length, only its end being threaded.

A distribution washer 93 (FIG. 1) is associated with the head of the screw 12 thus constituted, in the usual way.

The clamping screw 12' associated with the jaw 11' has a structure analogous to that of the screw 12.

The only difference is that its shank 89' is slightly shorter.

After punching out the breakable part 49' of the cheek members 50 of the insulative material member 43, the free end of the branch cable 15' is inserted into the housing 14' provided for it between the insulative material body 10 and the jaw 11', by feeding it through the corresponding openings 31 in the flanges 21 of the insulative material body 10.

The branch cable 15' is then provisionally clamped by the jaw 11' by sliding the latter along its guide rails 35'.

This temporary clamping is sufficient to retain the branching connector relative to the branch cable 15.

It has the advantage of being immediately implemented without requring the use of any tools.

The branching connector in accordance with the invention is then fitted to the main cable 15, by means of the housing 14, and, as before, provisional clamping is immediately effected by sliding the corresponding jaw 11 on the insulative material body 10.

All that is then needed is to operate on the operating head 85, 85' of the clamping screws 12, 12' to effect final clamping of the jaws 11, 11'.

During this clamping the teeth 39 of the projecting part 18 of the contact member 17 of the insulative material body 10 pierce the insulative sheath of the main cable 15 until they come into contact with and slightly penetrate into the conductive core of the latter, and the same applies to the blades 75 of the projecting part 66 of the contact member 65 of the jaw 11.

The teeth 39' of the projecting part 18' of the contact member 17 of the insulative material body 10 pierce the insulative sheath of the branch cable 15' until they come into contact with the conductive core of the latter and penetrate slightly into this conductive core, and the same applies to the blades 75' of the projecting part 66' of the contact member 65 of the jaw 11'.

In practice, operation of the operating head 85, 85' of the clamping screw 12, 12' is continued until, by breaking off in line with the groove 87, 87' the end portion 88, 88' of the operating head 85, 85' is detached from the remainder thereof.

In this way it is certain that a maximum torque cannot be exceeded.

It will be noted that by virtue of the trapping of the head 90 of the corresponding shank 89, 89' in the internal bore in the operating head 85, 85' of the clamping screw 12, 12', only the detachable portion of the operating head 85, 85' is actually affected by the clamping action exerted on the latter where this is applied from the inside.

In accordance with arrangements that are known per se, it is also possible to ensure that the same applies when this action is exerted from the outside, a stop ring being inserted to this end in the corresponding groove 87, 87' in order to limit penetration of the tool used for this purpose over the operating head 85, 85'.

As will be noted, neither clamping screw 12 or 12' has any contact with any active metal part of the branching connector in accordance with the invention.

Consequently, they may be operated using ordinary wrenches, not necessarily insulated wrenches.

As will also be noted the operation of the clamping screws 12, 12' is advantageously done from the same side of the branching connector in accordance with the invention, that is the outside surface of the back member 20 of its insulative material body 10.

This facilitates the use of the branching connector in accordance with the invention.

Be this as it may, on completion of the clamping up of the jaws 11, 11' of the connector, the various electrical contacts which are made within it are each surrounded by an insulative material part which in a very simple manner protects and insulates these electrical contacts from the outside environment.

By virtue of their elastically deformable lips and their cradle members, these insulative material parts apply and seal against the cables 15, 15' concerned, all around the projecting parts of the contact members then engaged therewith.

The clamping onto the hollow member 27 of the insulative material body and onto the contact member 17 equipping the latter of the rim 55 surrounding the hole 47 provided on the insulative material member 43 associated with said contact member 17 for its engagement over said hollow member 27 likewise contributes to the required sealing effect.

As will be noted, by virtue of the half-dovetail shape cross-section of the rails 35, 35' on the insulative material body 10 and the complementary profile of the corresponding grooves 63, 63' in the jaws 11, 11', said jaws 11, 11' advantageously procure, as a result of the clamping pressure developed by the clamping screws 12, 12', mechanical retention of the flanges 21 of said insulating material body 10, against any force tending to move them away from one another, without which the molding operations to be carried out would be considerably complicated.

It will also be noted that the clamping screws 12, 12' may be removed by operating from the outside on the base of the operating head 85, 85' which has remained in position.

It will finally be noted that, the housings 14, 14' provided in the branching connector in accordance with the invention for the main cable 15 and the branch cable 15' being parallel to one another, the outlet for the branch cable 15' is advatageously tangential to the main cable 15.

When there are two or more branch cables 15', 15'', etc to be taken into account, the branching connector in accordance with the invention comprises more than two jaws 11, 11', 11'', etc.

Figure 19:
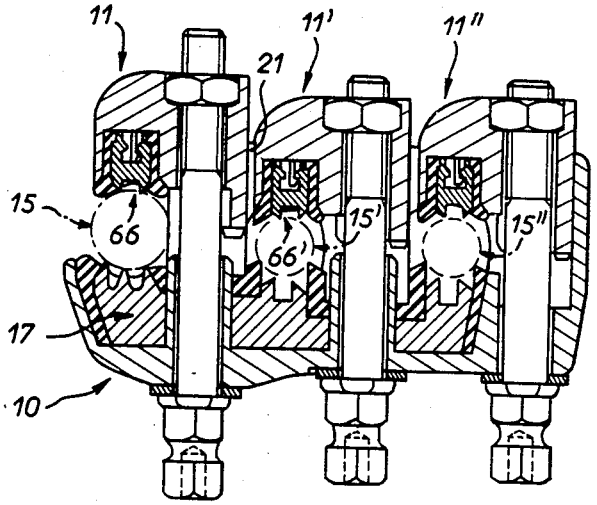
FIGS. 19 through 21 are views analogous to that of FIG. 18 and concerning respective alternative embodiments of the branching connector in accordance with the invention.

For example, as shown in FIG. 19, it may comprise two jaw 11', 11'' cooperating with the jaw 11 associated with the main cable 15, these various jaws 11, 11', 11'' being staggered over the height of the corresponding insulative material body 10, more precisely over the height of the flanges 21 of the latter, being mounted to slide parallel to themselves over these flanges 21, by virtue of arrangements identical to those described hereinabove.

As will be noted, the branch connections provided by the jaws 11, 11' are in this way totally independent of one another, both with regard to the fitting of the corresponding branch cables 15', 15'' and with regard to the removal thereof.

Likewise, and as for the branching connector previously described, any work on any branch cable has no effect on the electrical contact made with the corresponding main cable 15.

Figure 20:
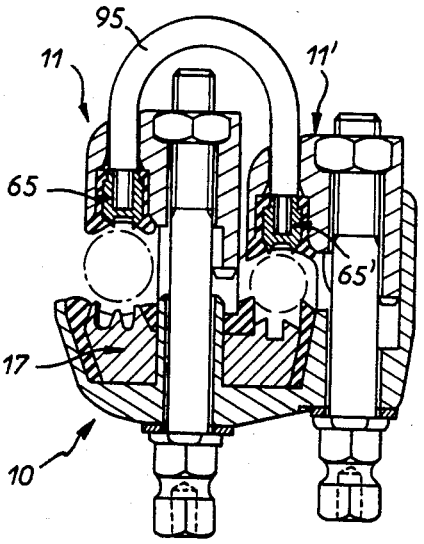

In the alternative embodiment shown in FIG. 20, which is of the same type as the embodiment with a single branch jaw 11'' described with reference to FIGS. 1 through 17, and which is more particularly intended for applications requiring a high flow of current between the main cable and the branch cable, there is provided between the contact members 65, 65' of the corresponding jaws 11, 11' a shunt 95 of flexible insulated cable which is electrically connected at its ends to said contact members 65, 65', connecting in a loop said jaws 11, 11' on the rear surface of the latter.

Figure 21:
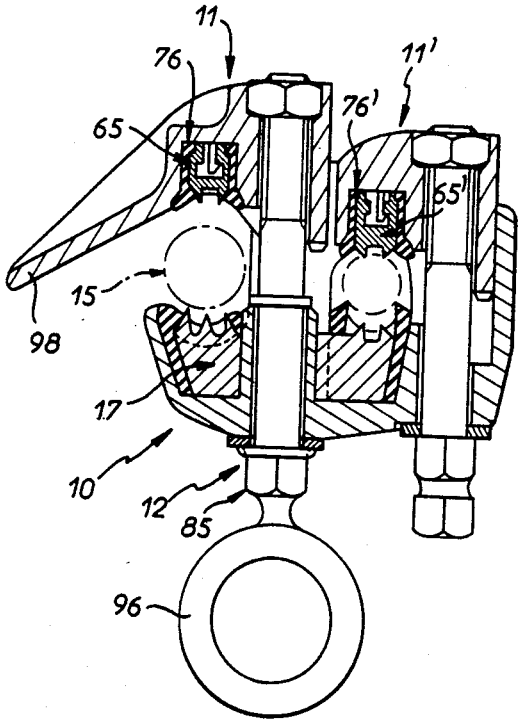

The alternative embodiment of FIG. 21 concerns the case where, for purposes of remote operation, the operating head 85 of the clamping screw 12 associated with the main cable 15 is provided, in the manner known per se, with a ring 96 adapted to allow it to be operated by means of an insulative rod appropriate to such remote operation.

Furthermore, in this alternative embodiment, the corresponding jaw 11 is provided with a tapered beak-shaped extension 98 which, when the main cable 15 is part of a twisted bundle, facilitates the fitting of the device to the main cable 15 by separating the latter from the other cables constituting the twisted bundle.

From the foregoing it is seen that, as described, the branching connector in accordance with the invention is an insulated and sealed separate branch connector operative by piercing the insulation on the main cable and on the branch cable or cables.

It is to be understood that the present invention is not limited to the various embodiments described and shown but encompasses all variations in terms of execution and/or combination of their various component parts.

I claim:

1. Branching connector of the kind comprising an insulative material body, an insulative material jaw movably mounted on said body under the control of clamping means and defining with the body a housing whereby the assembly may be fitted to a main cable, means for clamping said jaw, connecting means for connecting at least one branch cable to said body, and a metal contact member accommodated in said body and having an insulation piercing projecting part extending into said housing and adapted to make an electrical connection between said main cable and a branch cable of this kind, and is generally characterized in that at least the projecting part of the metal contact member which extends into the main cable housing is embedded in an insulative material dished member adapted to be applied against a cable of this kind all around said projecting part so as to protect and seal the electrical contact established between said projecting part and said main cable, in that the connecting means for connecting a branch cable to the body comprise a second jaw separate from the first jaw movably mounted on said body under the control of specific clamping means and defining with said body a housing adapted to have a branch cable inserted into it, and in that, the metal contact member comprising a second insulation piercing projecting part extending into the branch cable housing, this second projecting part is also embedded in an insulative material dished member adapted to be applied against the branch cable all around the second projecting part so as to protect and seal the electrical contact established between the second projecting part and said branch cable, whereby the connector constitutes a separate branch insulating branching connector, insulation piercing on the main cable and the branch cables(s).

2. Branching connector according to claim 1, characterized in that both dished members associated with the metal contact member are portions of one insulative material member which has a skirt engaged over said metal contact member and a back covering said metal contact member with two openings in said back for the respective projecting parts of said metal contact member to pass through.

3. Branching connector according to claim 2, characterized in that the clamping means for the jaw associated with the main cable housing comprise a screw and said back of said insulative material member constituting the two dished members associated with the metal contact member further comrises a central opening for said screw to pass through.

4. Branching connector according to claim 3, characterized in that said insulative material member is force fitted by means of said central opening over a hollow projection passing through said metal contact member and through which said screw passes.

5. Branching connector according to claim 4, characterized in that said central opening in said insulative material member is bordered by a rim.

6. Branching connector according to any one of claims 1 to 5, characterized in that each dished member comprises two elastically deformable lips extending parallel to the associated housing along the corresponding projecting part, one on each side thereof, adapted to be applied against the respective cable.

7. Branching connector according to claim 6, characterized in that, in the case of the main cable housing, said dished member further comprises two transverse cradle members adapted to be applied against said main cable, one on each side of the corresponding projecting part of the metal contact member.

8. Branching connector according to claim 6, characterized in that, in the case of the branch cable housing, said dished member further comprises two transverse cheek members one on each side of the corresponding projecting part of the metal contact member, each comprising a breakable part in line with said projecting part and each having an edge portion interlocked snap-fastener fashion in an opening in said body.

9. Branching connector according to claim 1, characterized in that the projecting part of said metal contact member is on a portion thereof separated from the remainder thereof by a slot.

10. Branching connector according to claim 1, characterized in that the clamping means for a jaw consist of a screw with an operating head at least part of which is adapted to twist off, said operating head forming a part separate from the shank with which it is associated, being appropriately attached to the latter, as by crimping for example, and of a material different than the material constituting said shank.

11. Branching connector according to claim 1, characterized in that the jaw associated with the main cable has a tapered beak-shaped extension.

12. Branching connector according to claim 1, characterized in that the insulative material body comprises a back member incorporating a housing for the metal contact member from the back of which projects at least one hollow member adapted to have a clamping screw passed through it and two side flanges extending along part of respective edges of said back member, the portion of said back member extending beyond said flanges constituting the main cable housing and each of said side flanges incorporating an opening for a branch cable to pass through.

13. Branching connector according to claim 12, characterized in that the insulative material body further conmprises a baseplate joining its two flanges at the base of its back member.

14. Branching connector according to claim 1, characterized in that the or each jaw slides on guide rails provided for this purpose on the insulative material body.

15. Branching connector according to claim 14, characterized in that said guide rails are half-dovetail shaped in transverse cross-section.

16. Branching connector according to claim 1, characterized in that in comprises more than two jaws.

17. Branching connector according to claim 16, characterized in that all the jaws are indentical.

18. Branching connector according to claim 16, characterized in that the jaws are staggered along the height of the insulative material body and all move parallel to one another.

19. Branching connector according to claim 1, characterized in that a jaw carries a metal contact member having a projecting part extending into the respective cable housing, and said projecting part at least of this metal contact member is embedded in an insulative material dished member adapted to be applied against a cable so as to protect and seal the electrical contact established between the projecting part and siad cable.

20. Branching connector according to claim 19, characterized in that the metal contact member of a jaw is a section of preshaped profiled metal.

21. Branching connector according to claim 19, characterized in that the metal contact member of a jaw is locked snap-fastener fashion in a housing in the latter.

22. Branching connector according to claim 19, characterized in that the projecting part of a metal contact member is an insulation piercing projection.

23. Branching connector according to claim 19, characterized in that the insulative material dished member that a jaw comprises has two elastically deformable lips parallel to the associated housing along the length of and one on each side of the projecting part of the metal contact member embedded in it, for application to the corresponding cable.

24. Branching connector according to claim 23, characterized in that said dished member further comprises two transverse cradle members each adapted to be applied against the respective cable, one on each side of the projecting part of the metal contact member embedded in it.

25. Branching connector according to claim 23, characterized in that said dished member comprises a skirt engaged over the metal contact member embedded in it.

* * * * *